US006595616B2

(12) United States Patent
Takahashi et al.

(10) Patent No.: US 6,595,616 B2
(45) Date of Patent: Jul. 22, 2003

(54) INK JET TYPE RECORDING APPARATUS

(75) Inventors: Masaru Takahashi, Nagano (JP); Hitoshi Hayakawa, Nagano (JP); Kojiro Iizuka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/984,845

(22) Filed: Oct. 31, 2001

(65) Prior Publication Data

US 2002/0063748 A1 May 30, 2002

(30) Foreign Application Priority Data

Oct. 31, 2000 (JP) ..... 2000-331773

(51) Int. Cl.[7] ..... B41J 2/165

(52) U.S. Cl. ..... 347/23; 347/29; 347/33; 347/35

(58) Field of Search ..... 347/23, 14, 29, 347/30, 33, 32, 35

(56) References Cited

U.S. PATENT DOCUMENTS 4,965,596 A * 10/1990 Nagoshi et al. ..... 347/36
5,172,140 A * 12/1992 Hirabayashi et al. ..... 347/36

* cited by examiner

*Primary Examiner*—Shih-wen Hsieh
(74) *Attorney, Agent, or Firm*—Sughrue Mion, PLLC

(57) ABSTRACT

There are provided a capping device capable of sealing a recording head mounted on a carriage and of sucking and discharging ink from the recording head, and a wiping member which advances to a moving path of the recording head and wipes waste ink off a nozzle forming surface of the recording head to clean the nozzle forming surface. A first drainage-amount integrating device for integrating and counting an amount corresponding to the waste ink to be wiped off the recording head by the wiping member is provided, and it is possible to prevent the contamination of the interior of the apparatus by excess waste ink.

13 Claims, 7 Drawing Sheets

FIG.8

| MODE | No. OF TIME OF WIPING | AMOUNT OF INK (gf) | DISCRETE VALUE OF DRAINAGE AMOUNT |
|---|---|---|---|
| CLEANING 1 | 1 | 0.01 | 10 |
| CLEANING 2 | 2 | 0.016 | 16 |
| CLEANING 3 | 2 | 0.022 | 22 |
| TIMER CLEANING | 1 | 0.008 | 8 |
| INITIAL LOADING | 3 | 0.03 | 30 |

INK JET TYPE RECORDING APPARATUS

CROSS REFERENCE TO RELATED APPLICATION

The present application is based on Japanese Patent Application No. 2000-331773, which is incorporated herein by reference.

BACKGROUND OF THE INVENTION

1. Field of the Invention

The present invention relates to an ink jet type recording apparatus including a recording head mounted on a reciprocating carriage and adapted to discharge droplets of ink on the basis of print data and a wiping member for wiping off ink attached to a nozzle forming surface of the recording head in sliding contact with the nozzle forming surface. Particularly, the present invention concerns a technique for controlling the amount of waste ink wiped off the nozzle forming surface by the wiping member.

2. Description of Related Art

An ink jet type recording apparatus of, for instance, a serial printing system is provided with an ink jet type recording head mounted on a carriage and adapted to move in the main scanning direction and a paper feeding means for transporting recording paper in the sub scanning direction perpendicular to the main scanning direction, and as droplets of ink are discharged from the recording head on the basis of print data, printing is executed on the recording paper. In the light of the fact that ink pressurized in a pressure generating chamber is discharged onto the recording paper through a nozzle opening in the form of droplets of ink to effect printing, the above-described ink jet type recording head has a problem in that clogging is likely to occur in the nozzle opening due to an increase in the viscosity of the ink or solidification of ink attributable to the evaporation of an ink solvent from the nozzle opening, attachment of dust, and the like, thereby possibly causing faulty printing.

For this reason, this type of ink jet type recording apparatus is provided with a capping means for sealing a nozzle forming surface of the recording head when printing is not performed. This capping means not only functions as a cover for preventing the drying of the ink at the nozzle opening in the recording head, but also has the function of recovering the capability of discharging ink droplets whereby when clogging has occurred in the nozzle opening, the nozzle forming surface is sealed, and negative pressure from a suction pump is applied so as to suck and discharge the ink from the nozzle opening, thereby overcoming the clogging of the nozzle opening.

The forcible processing of sucking and discharging the ink, which is effected to overcome the clogging of the recording head, is called cleaning operation, and is performed such as when printing is resumed after a long period of suspension of the recording apparatus and when the user has operated, for example, a cleaning switch upon recognizing faulty printing. Then, after the ink is sucked and discharged into the capping means from the recording head by applying negative pressure based on the suction pump, as described above, the operation of wiping and cleaning the nozzle forming surface is effected in an accompanying manner by a wiping member formed of such as a rubber material.

The aforementioned wiping member has the function of preventing waste ink from dripping down from the recording head which moves to a printing area by scraping off the ink attached to the nozzle forming surface as a consequence of the cleaning operation, and also has the function of forming a proper meniscus of the ink at the nozzle opening by coming into sliding contact with the nozzle forming surface of the recording head. For this reason, the wiping member is arranged to advance or retract in the horizontal direction with respect to a moving area of the recording head, as required.

Consequently, the waste ink wiped off the nozzle forming surface flows down the wiping member and drops from the wiping member. The waste ink dropping from the wiping member has the problems of not only contaminating a portion located immediately below the moving area where the wiping member advances and retracts, but also hampering the proper operating function of the wiping member as the waste ink flows over an extensive area and flows around to, for instance, a drive unit for horizontally advancing or retracting the wiping member. Furthermore, there is another problem in that part of the waste ink wiped off the nozzle forming surface by the wiping member also flows around to the suction pump for evacuating the internal space of the capping means, thereby hampering the proper operating function of the suction pump.

To overcome the above-described problems, a measure has been made to dispose a sheet-like drain-ink absorbing material, such as felt, on a frame inside the apparatus immediately below the wiping member, to thereby absorb and hold the drain ink. In addition, in a particular apparatus model, an arrangement has been proposed in which a drainage receiving member for receiving the waste ink scraped off by the wiping member is disposed, and a drainage absorbing material for absorbing and holding the waste ink is accommodated in this drainage receiving member.

However, in the former arrangement in which felt, for instance, is disposed on the frame inside the machine body immediately below the wiping member as described above, there is a limit to the waste-ink absorbing capacity, and there are cases where excess drain ink flows over the frame, and problems similar to those described above occur. In addition, even in the latter arrangement in which the drainage absorbing material is disposed in the drainage receiving member, if, for instance, manual cleaning operation is frequently utilized, a limit occurs to the waste-ink absorbing capacity, so that cases can occur in which the interior of the apparatus is similarly contaminated.

SUMMARY OF THE INVENTION

The present invention has been devised in view of the above-described problems, and its object is to provide an ink jet type recording apparatus which is so constructed as to be capable of controlling the amount of waste ink wiped off the recording head by the wiping member, making it possible to prevent the occurrence of the above-described contamination.

The ink jet type recording apparatus in accordance with the invention devised to attain the above object is an ink jet type recording apparatus including an ink jet type recording head mounted on a reciprocating carriage and adapted to discharge droplets of ink on the basis of print data, and a wiping member for wiping off ink attached to a nozzle forming surface of the recording head in sliding contact with the nozzle forming surface in conjunction with the movement of the carriage, characterized by: drainage-amount integrating means for integrating and counting an amount of drain ink wiped off the nozzle forming surface by the wiping member.

In this case, the drainage-amount integrating means is preferably used jointly with an arrangement in which a draining absorbing material for absorbing and holding the waste ink wiped off the nozzle forming surface by the wiping member is disposed. More preferably, the drainage-amount integrating means is used jointly with an arrangement in which the wiping member is arranged to be advanced or retracted with respect to a moving path of the recording head and to wipe off the ink attached to the nozzle forming surface by coming into sliding contact with the nozzle forming surface of the recording head in a state in which the wiping member has advanced to the moving path of the recording head, a drainage receiving member for receiving the drain ink wiped off by the wiping member is disposed immediately below the moving path of the wiping member corresponding to a gravitational direction of the wiping member, and the drainage absorbing material for absorbing and holding the drain ink is disposed in the drainage receiving member.

Further, the drainage-amount integrating means for integrating and counting the amount of drain ink wiped off the nozzle forming surface by the wiping member is preferably arranged to effect integration and counting each time the wiping operation is executed. In this case, the drainage-amount integrating means may be arranged to integrate and count a predetermined value each time the wiping operation is executed.

In addition, it is possible to suitably adopt an arrangement in which the drainage-amount integrating means for integrating and counting the amount of drain ink wiped off the nozzle forming surface by the wiping member effects integration and counting each time the operation of cleaning the recording head is executed. In this case, the drainage-amount integrating means may be arranged to integrate and count a predetermined value each time the operation of cleaning the recording head is executed.

In addition, in a preferred form, the ink jet type recording apparatus may further comprise: drainage-amount integrating means for integrating and counting the amount of drain ink occurring on the basis of the operation of cleaning the recording head or the operation of flushing the recording head.

On the other hand, there are cases where the drainage-amount integrating means for integrating and counting the amount of drain ink wiped off the nozzle forming surface by the wiping member is arranged to effect integration and counting when operating power supply for the recording apparatus is interrupted.

In addition, in a preferred form, the ink jet type recording apparatus may further comprise: integrated-value determining means for determining whether or not a discrete value of the drainage-amount integrating means for integrating and counting the amount of drain ink wiped off the nozzle forming surface by the wiping member has reached a predetermined value, wherein if it is determined by the integrated-value determining means that the predetermined value has been reached, a message is displayed by display means. Additionally, it is preferred that if it is determined by the integrated-value determining means that the predetermined value has been reached, the operation of cleaning the recording head or the wiping operation be arranged to be prohibited.

According to the ink jet type recording apparatus constructed as described above, the amount of drain ink wiped off the recording head by the wiping member in consequence of, for example, the operation of cleaning the recording head is integrated and counted by the drainage-amount integrating means, so that it is possible to ascertain the same. Then, drainage-amount integrating means is capable of performing the integration and counting each time the wiping operation is executed, or each time the operation of cleaning the recording head is executed, or when the operating power supply for the recording apparatus is interrupted. In this case, if a constant set in advance for the drainage-amount integrating means in correspondence with, for instance, a mode of the cleaning operation is integrated, sufficient integration and counting can be executed for practical purposes.

Then, if it is determined by the integrated-value determining means that the count of the drainage-amount integrating means has reached a predetermined value, a message is arranged to be displayed by the display means, thereby making it possible to notify the user that maintenance is required. At the time same, if an arrangement is provided to prohibit the operation of cleaning the recording head or the wiping operation, it is possible to prevent the occurrence of contamination of the interior of the apparatus by excess drain ink.

BRIEF DESCRIPTION OF THE DRAWINGS

FIG. 8 is a map describing the relationship between respective operating modes and discrete values of the amount of drainage which is used in the control circuit shown in FIG. 7.

DETAILED DESCRIPTION OF THE PREFERRED EMBODIMENTS

Figure 1:
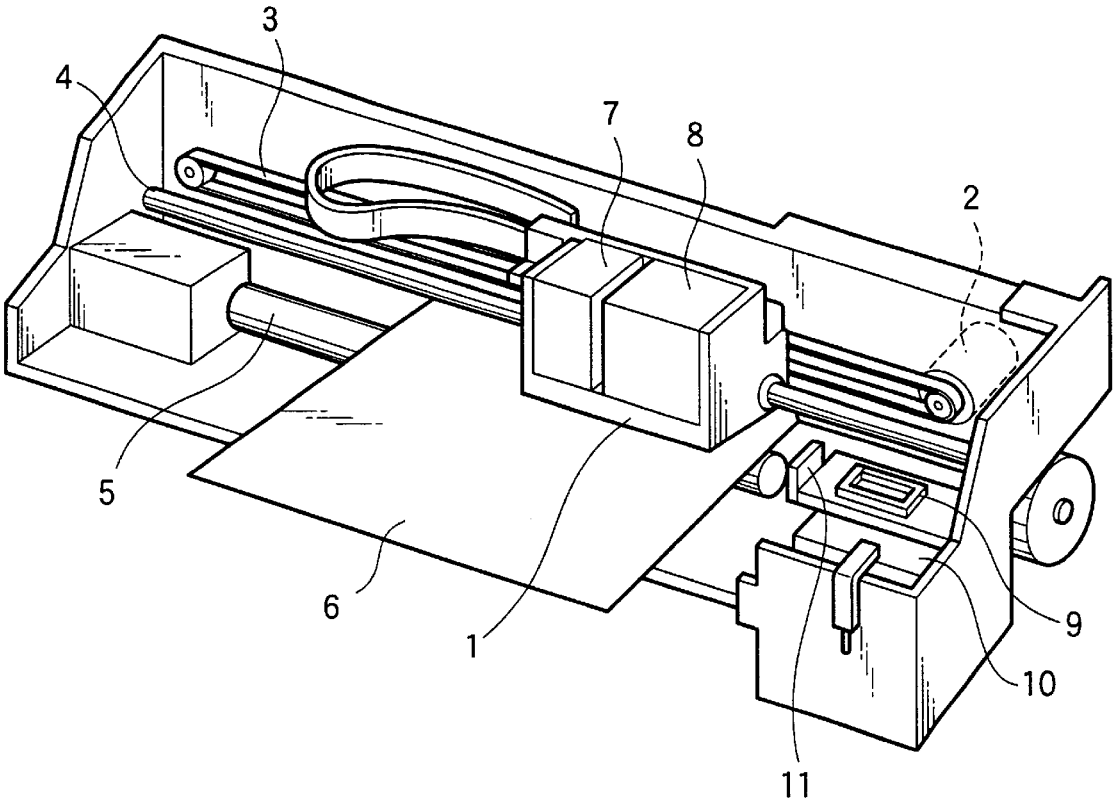
FIG. 1 is a perspective view illustrating a basic configuration of an ink jet type recording apparatus to which the invention is applied.

Hereafter, a description will be given of an ink jet type recording apparatus in accordance with the invention on the basis of an embodiment illustrated in the drawings. FIG. 1 illustrates a basic configuration of the ink jet type recording apparatus to which the invention is applied. In FIG. 1, a carriage 1 is arranged to be reciprocated in the axial direction of a platen 5 by means of a timing belt 3, which is driven by a carriage motor 2, while being guided by a guide member 4.

Although it does not appear in FIG. 1, an ink jet type recording head which will be described later is mounted on the surface (lower surface) of the carriage 1 opposing recording paper 6, and is arranged such that its nozzle forming surface opposes the recording paper 6 with a slight gap therebetween. A black ink cartridge 7 and a color ink cartridge 8 for supplying ink to the recording head are detachably loaded in an upper portion of the carriage 1, and the arrangement provided is such that ink can be supplied to the recording head by each of these cartridges.

In FIG. 1, a capping means 9 is disposed in a nonprinting area (home position), and the arrangement provided is such that when the recording head mounted on the carriage 1 has moved immediately above it, the capping means 9 is raised so as to be able to seal the nozzle forming surface of the recording head. A suction pump 10 for imparting negative pressure to the inner space of the capping means 9 is disposed at a position adjacent to the capping means 9.

The capping means 9 not only functions as a cover for preventing the drying of the nozzle opening in the recording head during the period when the recording apparatus is out of operation, but also has the function as a cleaning means for sucking and discharging ink from the recording head by applying the negative pressure from the suction pump 10 to the recording head. Further, the capping means 9 also has the function for receiving ink droplets during the operation of flushing for effecting no-load discharging of ink droplets irrelevant to printing from the nozzle opening of the recording head.

In addition, a wiping member 11 obtained by forming a rubber material into the shape of a strip is disposed on the printing area side adjacent to the capping means 9 so as to be capable of advancing or retracting in the horizontal direction. The arrangement provided is such that when the carriage 1 reciprocates to and from the capping means 9 side, the wiping member 11 is capable of wiping the nozzle forming surface of the recording head, as required. As a result, it is possible to wipe off the ink attached to the nozzle forming surface after the cleaning operation, for instance, so that it is possible to prevent contaminating the recording paper and the like due to such as the dripping down of the ink from the recording head.

Figure 2:
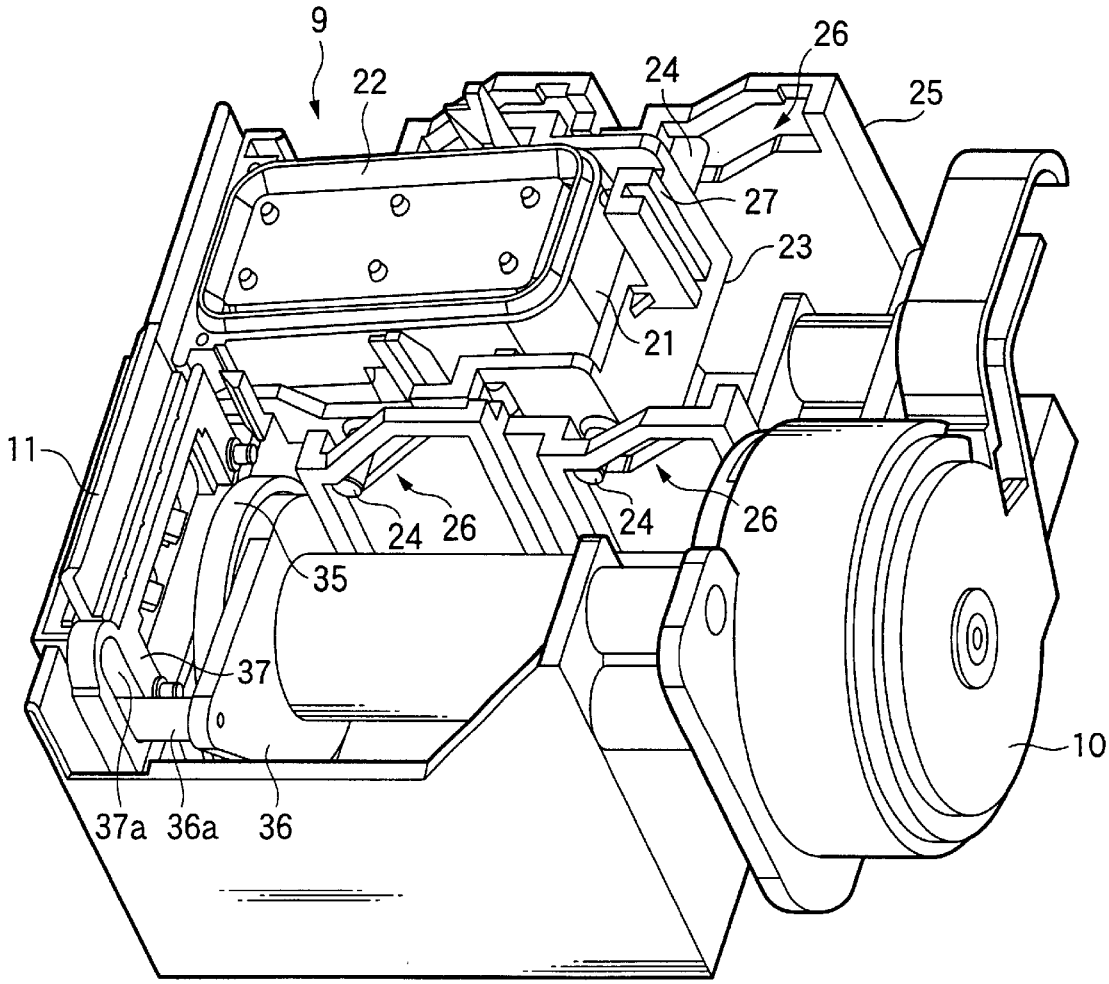
FIG. 2 is a perspective view illustrating a drive mechanism and the like of a wiping member mounted in the recording apparatus shown in FIG. 1.
Figure 3:
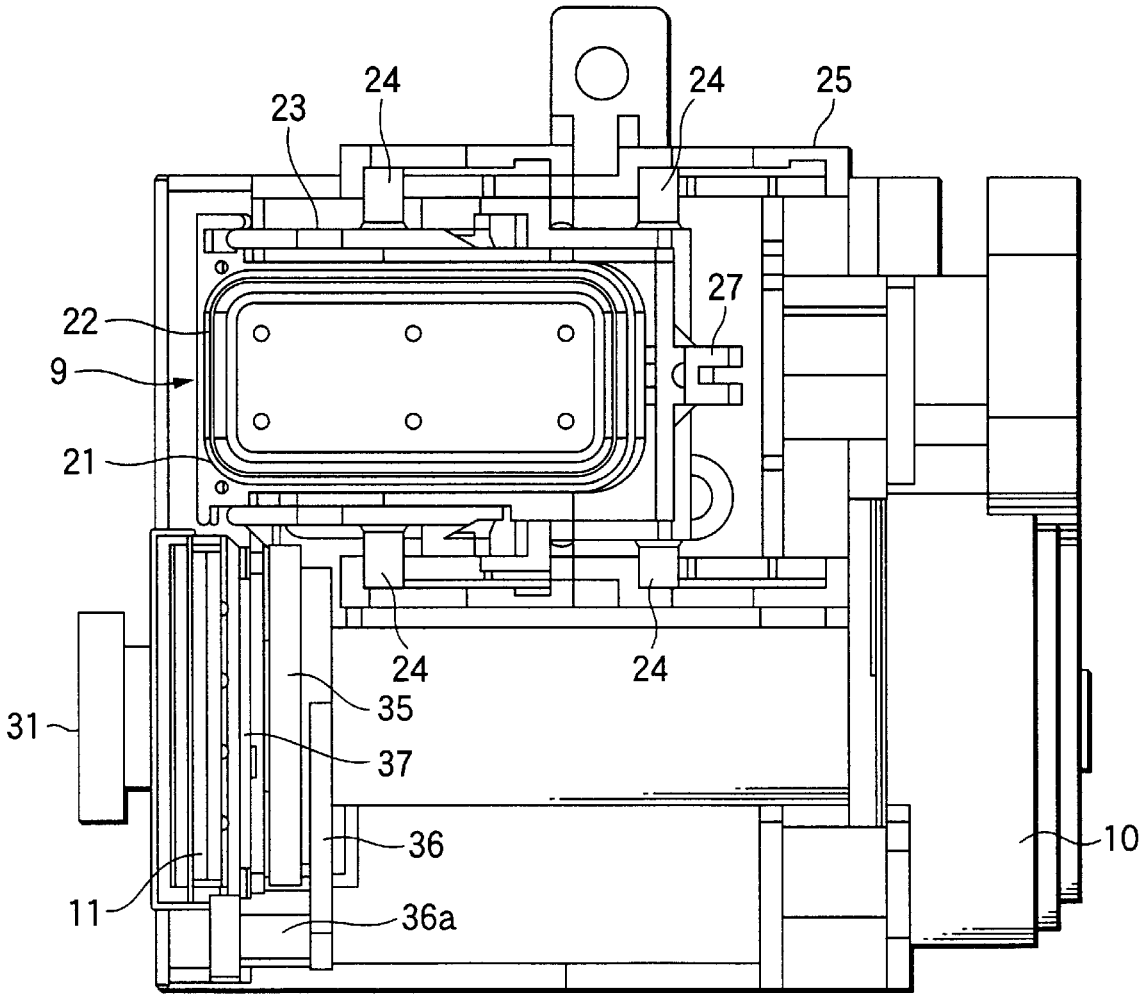
FIG. 3 is a plan view similarly illustrating the drive mechanism and the like of the wiping member.

Next, FIGS. 2 and 3 show a state in which a drive mechanism of the capping means 9, the tube pump 10 serving as the suction pump, and a drive mechanism of the wiping member 11, which are mounted in the recording apparatus, are formed as a unit. It should be noted that FIG. 2 illustrates this state in a perspective view, while FIG. 3 illustrates it in a plan view.

The capping means 9 capable of sealing the nozzle forming surface of the recording head is provided with a cap holder 21 formed in a square shape, and a cap member 22 made of a flexible material such as an elastomer is formed at an open peripheral edge of the cap holder 21. The arrangement provided is such that the nozzle forming surface of the recording head can be sealed by this cap member 22.

The cap holder 21 is mounted on a slider 23 which makes up a lifting mechanism, and a plurality of guide projections 24 are formed on the slider 23 in such a manner as to project therefrom horizontally. The guide projections 24 are respectively accommodated in elongated inclined holes 26 formed in a frame 25 for sliding and holding the slider 23. Meanwhile, an engaging projection 27 is formed integrally on the slider 23 in an upright state. This engaging projection 27 has the function whereby when the aforementioned carriage 1 has moved to its home position, the engaging projection 27 engages a portion of the carriage 1 moves the slider 23 in the moving direction of the carriage 1 upon receiving the driving force of the carriage 1.

Accordingly, in conjunction with the moving operation of the carriage 1 to the home position side, the respective guide projections 24 formed on the slider 23 rise up through the elongated inclined holes 26 formed in the frame 25. Accordingly, the nozzle forming surface of the recording head mounted on the carriage 1 is sealed by the cap member 22 formed on the cap holder 21, and is thereby set in a capped state.

Although it does not appear in the drawings, a spring member for pushing the cap holder 21 upward is disposed between the slider 23 and the cap holder 21. Accordingly, in the capped state, the spring member is slightly compressed, and the cap member 22 formed on the cap holder 21 is pressed onto the nozzle forming surface of the recording head with an appropriate pressure by that urging force. Meanwhile, when the carriage 1 has moved to the printing area side, the slider 23, upon receiving the action of an unillustrated return spring, moves to the printing area side. In conjunction with this movement, the sealing of the nozzle forming surface of the recording head by the cap member 22 is canceled.

Although it does not appear in FIGS. 2 and 3, an ink discharge port is formed in such a manner as to extend from an inner bottom portion of the cap holder 21 to a lower surface thereof, and a tube which makes up a suction side of the suction pump 10 serving as the aforementioned suction pump is connected to this ink discharge port. This tube pump 10 generates negative pressure as a flexible tube disposed in a circular arc shape is consecutively squeezed by a roller. As a drive wheel 31 shown in FIG. 3 is rotatively driven in one direction, the pumping action is generated, and as the drive wheel 31 is rotatively driven in the other direction, the tube pump 10 is set in a released state. It should be noted that, in this embodiment, the drive wheel 31 is arranged to drive via a speed-reducing gear train the power of a paper feeding motor for loading or discharging the recording paper 6.

Accordingly, as the tube pump 10 is driven in the state in which the nozzle forming surface is sealed by the cap member 22 making up the capping means 9, it is possible to impart negative pressure to the nozzle forming surface of the recording head. Due to the action of this negative pressure, the cleaning operation for sucking and discharging the ink from the recording head is carried out. Then, as the carriage 1 is slightly moved to the printing area side, the sealing of the nozzle forming surface by the cap member 22 is canceled. As the tube pump 10 is driven again in this state, the drain ink discharged into the capping means 9 can be fed through the tube pump 10 to a drain dank which will be described later.

On the other hand, a cam-shaped member 36 is arranged to be rotated by means of a clutch plate 35 which is driven in conjunction with the rotation of the drive wheel 31. This cam-shaped member 36 is brought into pressure contact with the clutch plate 35 by an unillustrated spring member, and is arranged to receive rotative drive in a predetermined range of rotational angle by being dragged in the rotating direction of the clutch plate 35. Further, a circular column-shaped drive pin 36*a* is attached to the cam-shaped member 36 so as to project in the horizontal direction.

The aforementioned wiping member 11 is supported so as to be set in an upright state on an upper portion of a lever member 37 which is arranged to be horizontally movable. Further, a slot 37*a* is formed vertically in the lever member 37, and the circular column-shaped drive pin 36*a* is inserted in this slot 27*a*. Accordingly, the drive pin 36*a* which is driven with a circular arc-shaped locus by means of the friction clutch based on the clutch plate 35 and the cam-shaped member 36 slides in the slot 37*a* formed vertically in the lever member 37, thereby acting so as to move the lever member 37 in the horizontal direction. It should be noted that the state shown in FIGS. 2 and 3 shows a reset state in which the wiping member 11 disposed on the upper portion of the lever member 37 is retreated from the moving area of the recording head.

In this embodiment, the pumping action of the tube pump 10 is effected by the rotation in one direction of the paper feeding motor. During an initial period of the rotating motion at this time, the lever member 37 is driven horizontally by means of the friction clutch, and the wiping member 11 is arranged to be set in a set state in which the wiping member 11 is advanced in the moving path of the recording head. Accordingly, as the recording head moves in the main scanning direction at this time, its nozzle forming surface is wiped by the wiping member 11. Meanwhile, as the paper feeding motor is rotated in the other direction, the tube pump 10 is set in the released state. During the initial period of the rotating motion at this time, the lever member 37 is driven horizontally by means of the friction clutch, and the wiping member 11 is set in the reset state in which it is retreated from the moving area of the recording head.

Figure 4:
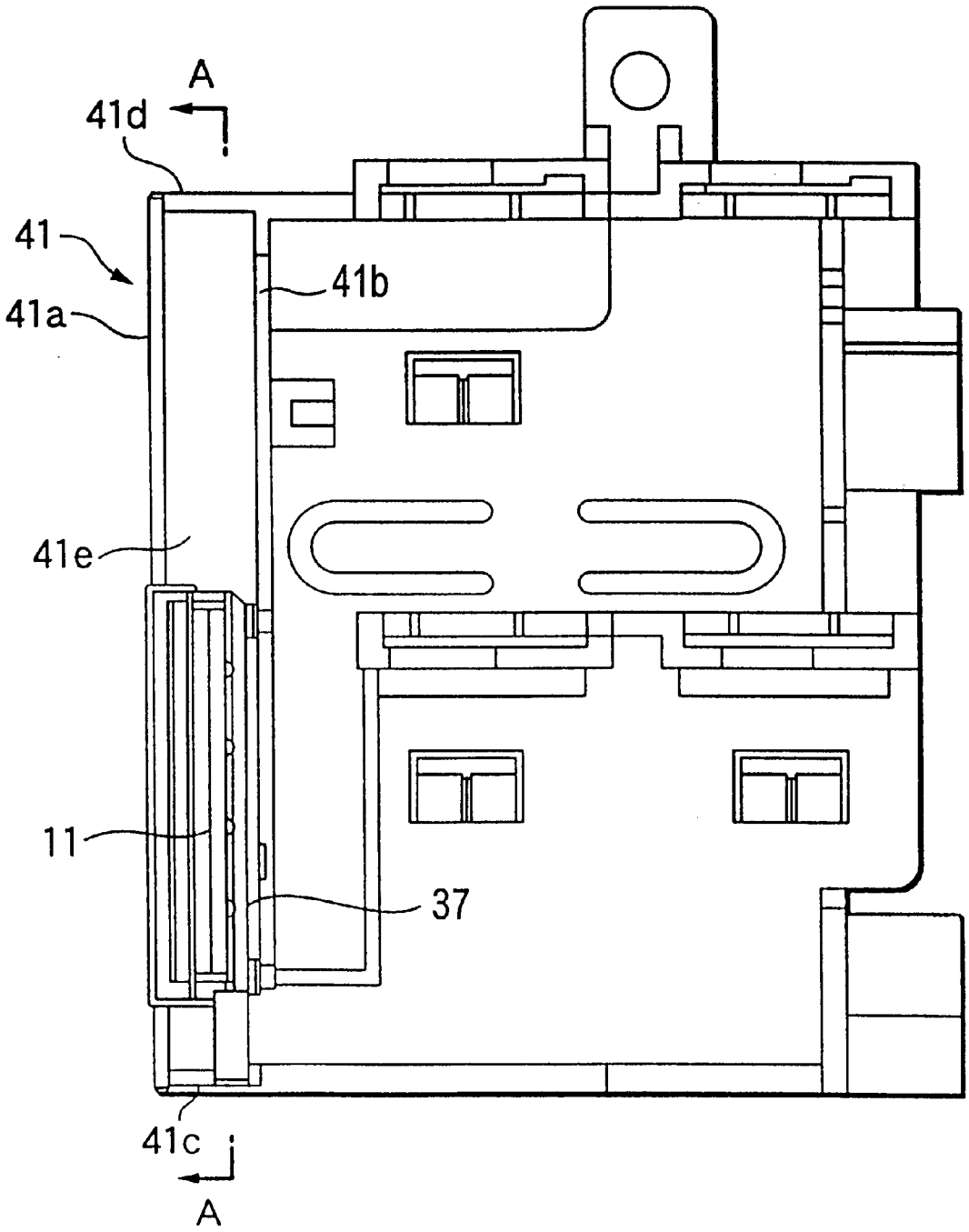
FIG. 4 is a plan view illustrating a state in which a driving mechanism and the like for a capping means are removed from the arrangement shown in FIGS. 2 and 3.
Figure 5:
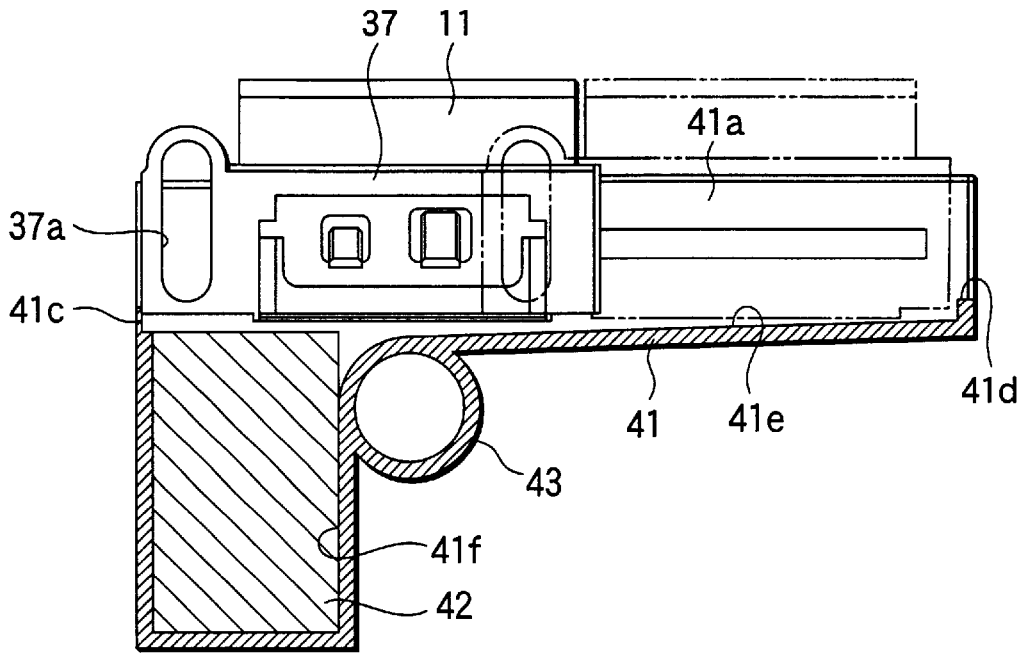
FIG. 5 is a cross-sectional view illustrating a first form of a drainage receiving member, and taken in the direction of arrows along line A—A in FIG. 4.

FIG. 4 shows in a plan view a state in which the capping means 9, its driving mechanism, the tube pump 10 serving as the suction pump, and the friction clutch portion for horizontally driving the wiping member 11, which are shown in FIGS. 2 and 3, are removed. In addition, FIG. 5 is a cross-sectional view taken in the direction of arrows along line A—A in FIG. 4. As shown in FIG. 4, a drainage receiving member 41 for receiving the drain ink wiped off by the wiping member 11 is formed immediately below the moving path of the lever member 37 for holding the wiping member 11 corresponding to the gravitational direction of the lever member 37. The drainage receiving member 41 has a size for covering the area located immediately below the moving path of the lever member 37 for holding the wiping member 11 corresponding to the gravitational direction of the lever member 37.

A pair of wall members 41*a* and 41*b* are formed on the drainage receiving member 41 in such a manner as to sandwich the lever member 37 and rise upward along the moving direction of the lever member 37. In addition, the phantom lines in FIG. 5 show the position in which the wiping member 11 is set in the set state. As can be seen from this drawing as well, a pair of wall members 41*c* and 41*d* are formed on both outer sides of the moving area of the lever member 37 in such a manner as to slightly rise upward. By virtue of the presence of these wall members surrounding the four sides, the drain ink which flows down the wiping member 11 and drops from the lever member 37 in the gravitational direction is reliably captured by the drainage receiving member 41.

As shown in FIG. 5, an inclined surface 41*e* which slopes slightly downward in the gravitational direction is formed in the drainage receiving member 41 immediately below the moving path of the wiping member 11 corresponding to the gravitational direction of the wiping member 11 in such a manner as to extend from one side to the other, i.e., from the set position to the reset position of the wiping member 11. Further, a drainage storage chamber 41*f* having a space portion with the shape of a rectangular parallelepiped is formed at an end portion in the gravitational direction of the inclined surface 41*e*, and a drainage absorbing material 42 formed of, for example, urethane foam, is accommodated in this drainage storage chamber 41*f*.

It should be noted that an unillustrated drive shaft for transmitting a driving force from the drive wheel 31 to the tube pump 10 is arranged to be inserted in a tubular member 43 formed in an outer portion where the inclined surface 41*e* perpendicularly meets the drainage storage chamber 41*f*.

In the above-described arrangement, the drain ink wiped off from the nozzle forming surface of the recording head by the wiping member 11 which is brought in the set state flows down the wiping member 11 and reaches the lever member 37, and flows in the gravitational direction along its surface. Then, the drain ink drops in the gravitational direction from any portion of a lower end portion of the lever member 37. The dropping of the drain ink from the lever member 37 occurs irrespective of whether the wiping member 11 is in the set state or the reset state.

Then, the drain ink which drops from the lever member 37 is captured at any position of the aforementioned drainage receiving member 41. In this case, in the form shown in FIG. 5, the drain ink which drops in the state in which the wiping member 11 is present in the set position is received by the aforementioned inclined surface 41*e*. Then, the drain ink flows down the inclined surface 41*e* to the drainage storage chamber 41*f*, and is absorbed and held in the drainage absorbing material 42 accommodated in the drainage storage chamber 41*f*. Meanwhile, the drain ink which drops in the state in which the wiping member 11 is present in the reset position is received by the aforementioned inclined surface 41*e* or the drainage absorbing material 42 accommodated in the drainage storage chamber 41*f*, and is consequently absorbed and held in the drainage absorbing material 42.

Figure 6:
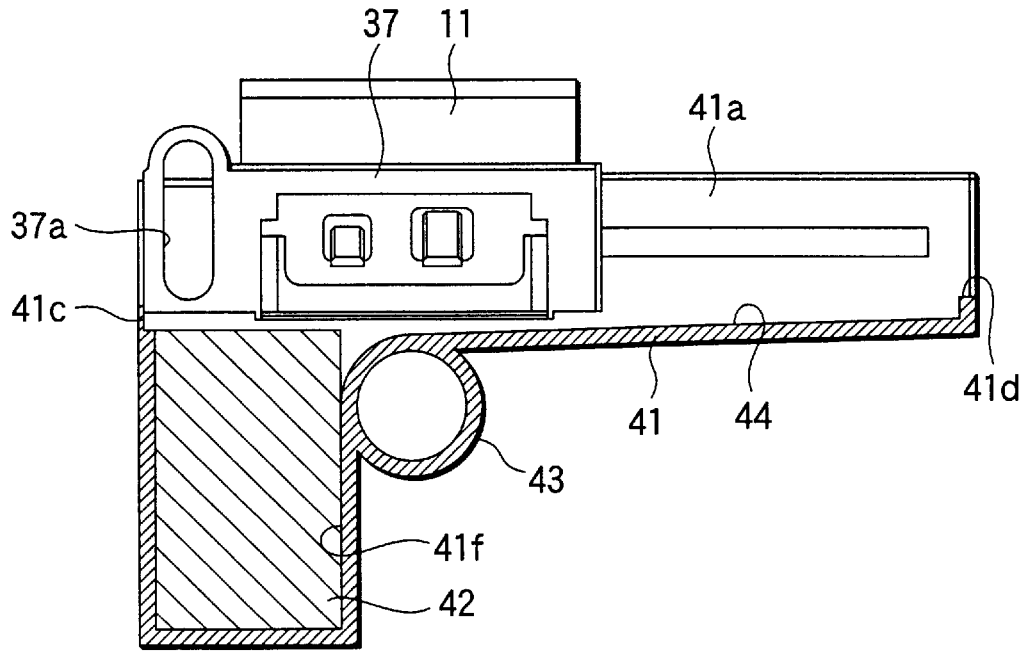
FIG. 6 is a cross-sectional view similarly illustrating a second form of the drainage receiving member.

Next, the form shown in FIG. 6 illustrates a more preferable form of the drainage receiving member 41 shown in FIG. 5. Namely, a guide sheet 44 for the drain ink is arranged along the inclined surface 41*e* of the drainage receiving member 41 shown in FIG. 5, and an end portion of the guide sheet 44 is disposed so as to reach the drainage absorbing material 42 accommodated in the drainage storage chamber 41*f*. According to this arrangement, the drain ink which dropped to the inclined surface 41*e* can be received by the sheet 44. The drain ink then flows down the sheet 44 and moves to the drainage absorbing material 42 accommodated in the drainage storage chamber 41*f*.

According to the form shown in FIG. 6, even in a case where the recording apparatus is substantially tilted such as when it is transported, the drain ink which is present on the inclined surface 41*e* can be held by the sheet 44, so that it is possible to prevent the problem that the drain ink which is present of the inclined surface leaks to the outside.

Figure 7:
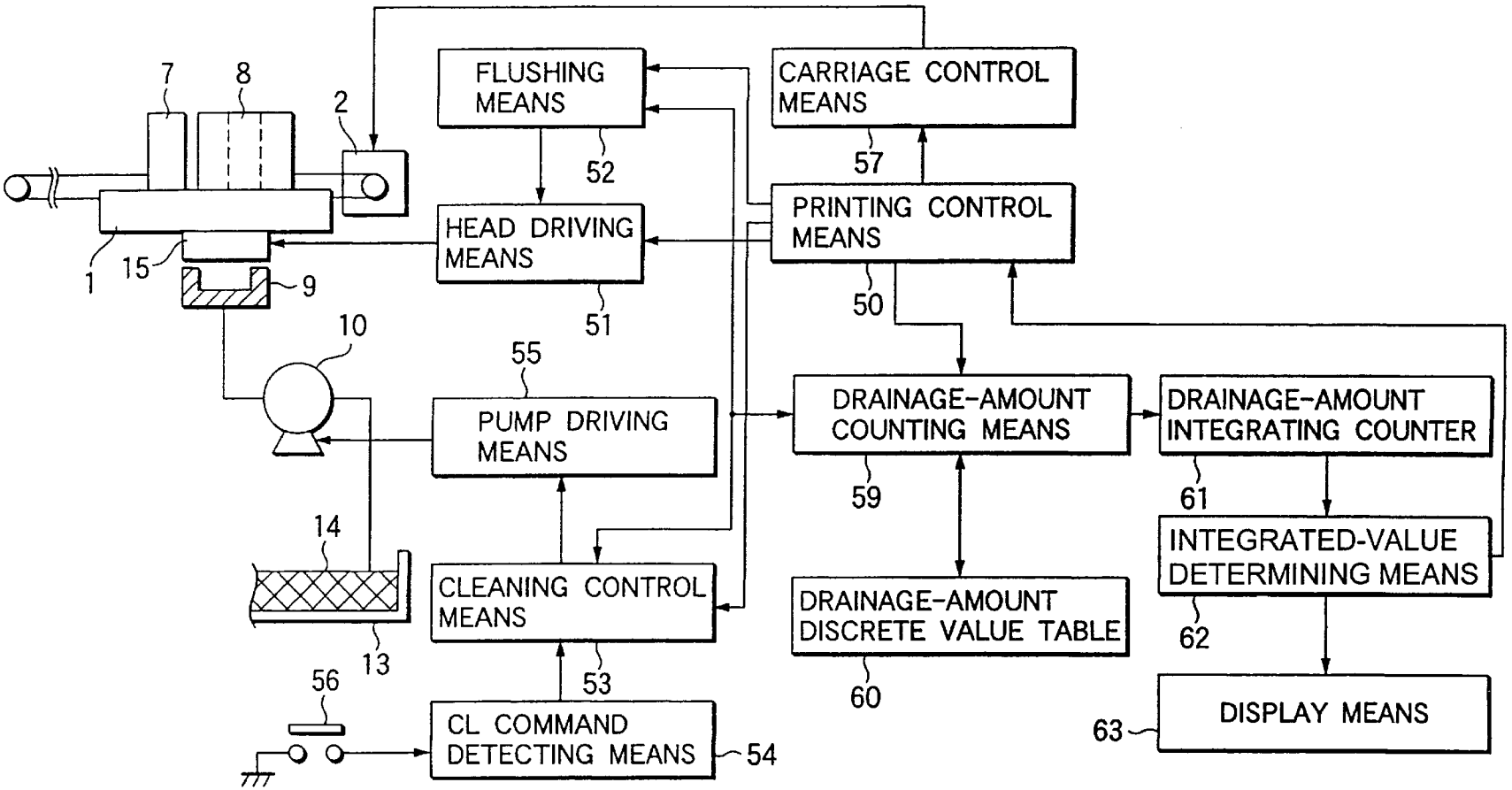
FIG. 7 is a block diagram illustrating one example of a control circuit which is capable of counting the amount of drain ink occurring in a case where the wiping operation has been executed.

FIG. 7 shows one example of a control circuit which is mounted in the recording apparatus having the above-described construction and which is capable of counting the amount of drain ink wiped off the nozzle forming surface of the recording head by the above-described wiping action. Incidentally, in FIG. 7, portions which correspond to the portions already described are denoted by the same reference numerals, so that a redundant explanation will be omitted. As shown in FIG. 7, a recording head 15 is mounted on the lower surface of the carriage 1, and the nozzle forming surface formed on the lower surface of this recording head 15 is arranged to be able to be sealed by the capping means 9, as described above.

The arrangement provided is such that the negative pressure based on the above-described suction pump 10 is applied to the lower bottom portion of the capping means 9, and the discharge side of the suction pump 10 is led to a drainage tank 13 in which a drainage absorbing material 14 is accommodated.

In FIG. 7, a printing control means 50 has the functions of generating bit map-data on the basis of print data from a host computer, of causing a head driving means 51 to generate a drive signal on the basis of this data, and of causing the recording head 15 mounted on the carriage 1 to discharge droplets of ink. This head driving means 51 is further arranged to output, in addition to the drive signal based on the print data, a drive signal for the flushing operation to the recording head 15 upon receiving a flushing command signal from a flushing control means 52.

A cleaning control means 53 has the function of driving the suction pump 10 by controlling a pump driving means 55 upon receiving a control signal from a cleaning-command detecting means 54. In addition, the arrangement provided is such that as a cleaning command switch 56 disposed on an operation panel or the like of the recording apparatus is operated, the cleaning-command detecting means 54 is operated to allow manual cleaning operation to be performed.

In addition, the cleaning control means 53 is arranged to receive a control signal from the printing control means 50, whereby the cleaning control means 53 further has the function of executing timer cleaning or the like for driving the suction pump 10 by controlling the pump driving means 55 in a similar manner.

Meanwhile, a control signal is arranged to be transmitted from the printing control means 50 to a carriage-motor control means 57. A drive signal is transmitted from the carriage-motor control means 57 to the carriage motor 2, and as the carriage motor 2 is driven, the carriage 1 is moved in the main scanning direction to execute the printing operation. In addition, in response to a command outputted from the carriage-motor control means 57, the carriage 1 is moved to execute the operation of the above-described capped state or the wiping operation and the like.

The printing control means 50 is arranged to transmit a control signal to a drainage-amount counting means 59, and information signal concerning the drain ink are arranged to be also transmitted to the drainage-amount counting means 59 from the cleaning control means 53 and the flushing control means 52. This drainage-amount counting means 59 has the function of counting first information corresponding to the amount of drain ink wiped off the nozzle forming surface by the wiping member 11, i.e., the amount of drain ink absorbed and held in the aforementioned drainage absorbing material 42 accommodated in the drainage storage chamber 41*f*.

The drainage-amount counting means 59 further has the function of counting second information corresponding to the amount of drain ink which has been discharged into the capping means 9 and has been fed into the drainage absorbing material 14 inside the drainage tank 13 by the driving of the suction pump 10, on the basis of the operation of cleaning the recording head or the operation of flushing the recording head. For this reason, the drainage-amount counting means 59 is arranged to effect a changeover between the function of counting the first information and the function of counting the second information in accordance with a control signal from the printing control means 50. Then, discrete values of the first information and the second information counted by the drainage-amount counting means 59 are respectively separately sent to a drainage-amount integrating counter 61 making up a drainage-amount integrating means, and the first information and the second information are separately integrated by the counter.

In this case, the drainage-amount counting means 59 operates so as to refer to a map of discrete values of the amount of drainage corresponding to cleaning modes and structured in a drainage-amount counting table 60 and send the discrete value to the drainage-amount integrating counter 61. FIG. 8 shows an example of the drainage-amount discrete value map structured in the drainage-amount counting table 60 so as to obtain the first information corresponding to the amount of drainage of ink wiped off the nozzle forming surface by the wiping member 11. In the drainage-amount discrete value map structured in the drainage-amount counting table 60, the amount of drainage is defined as a constant in correspondence with a cleaning operation mode.

Namely, the "cleaning 1" mode indicates a case in which as the user operates, for example, the cleaning command switch 56, the cleaning-command detecting means 54 is operated to execute the manual cleaning operation. In this case, the number of times of wiping in the cleaning sequence is one time, and the amount of ink wiped off the nozzle forming surface in this one wiping operation is 0.01 (gf) on the average. Accordingly, the discrete value of the amount of drainage at this time is defined as "10."

In addition, the "cleaning 2" mode is a cleaning operation mode which is more powerful than the aforementioned "cleaning 1" mode, and in which the amount of ink sucked and discharged from the recording head increases. In this case, the wiping operation is performed two times, and the amount of ink wiped off the nozzle forming surface in the wiping operation performed two times becomes greater than the case where the "cleaning 1" mode is performed. As shown in FIG. 8, the discrete value of the amount of drainage at this time is defined as "16." In addition, the "cleaning 3" mode indicates an example of the case in which the replacement cleaning operation performed when, for example, the ink cartridge has been replaced is carried out.

Further, the "timer cleaning" mode is periodically executed to discharge the ink whose viscosity has increased in the recording head with the lapse of a predetermined time. Furthermore, the "time of initial loading" mode is executed when ink is charged in the recording apparatus for the first time. The respective numbers of times of wiping corresponding to the respective aforementioned cleaning modes and the discrete values of the amount of ink wiped off the nozzle forming surface by that wiping operation are shown in FIG. 8.

It should be noted that the discrete values for counting the second information corresponding to the amount of drain ink, which is discharged into the capping means 9 and fed into the drainage absorbing material 14 in the drainage tank 13 on the basis of the cleaning operation or the operation of flushing the recording head, are similarly defined in the drainage-amount counting table 60 in correspondence with the cleaning modes, but a detailed description thereof will be omitted.

In this embodiment, in the case where the above-described first information and second information are obtained, the drainage-amount counting means 59 operates to count the amount of drain ink each time the respective cleaning operation has been executed, and to send the discrete values of the first and second information to the drainage-amount integrating counter 61. The drainage-amount integrating counter 61 is adapted to retain integrated values of the first and second information separately.

The respective integrated values are arranged to be sent to an integrated-value determining means 62 from the drainage-amount integrating counter 61, and this integrated-value determining means 62 functions to determine whether or not the respective integrated values have reached predetermined values (thresholds). If it is determined that the integrated value of the first information or the second information has reached the predetermined value, the integrated-value determining means 62 is adapted to send a control signal to a display means 63 and the printing control means 50.

For example, when the first information corresponding to the amount of drain ink wiped off the nozzle forming surface by the wiping member 11 has reached a predetermined value, it means that the drainage absorbing capacity in the drainage absorbing material 42 accommodated in the drainage receiving member 41 is full. In this case, a display for prompting maintenance, such as the replacement of the drainage absorbing material 42, is given by the display means 63. In addition, in this case, upon receiving a command from the integrated-value determining means 62, the printing control means 50 is controlled to prohibit the cleaning operation or the wiping operation of the recording head. As a result, it is possible to avoid the drain ink from overflowing from the drainage receiving member 41 and contaminating the interior of the apparatus.

On the other hand, if it is determined that the second information corresponding to the amount of drain ink, which is discharged into the capping means 9 and fed into the drainage absorbing material 14 in the drainage tank 13 on the basis of the cleaning operation or the operation of flushing the recording head, has reached a predetermined value, it means that the drainage absorbing capacity in the drainage absorbing material 14 in the drainage tank 13 is full. In this case, a display for prompting maintenance, such as the replacement of the drainage absorbing material 14, is similarly given by the display means 63. In addition, in this case, upon receiving a command from the integrated-value determining means 62, the printing control means 50 is controlled to prohibit the operation of cleaning the recording head. As a result, it is possible to avoid the drain ink from overflowing from the drainage tank 13 and contaminating the interior of the apparatus.

It should be noted that although in the above-described embodiment the drain ink wiped off the nozzle forming surface by the wiping member is arranged to be guided to the drainage absorbing material accommodated in the draining receiving member, it goes without saying that the invention is also applicable to a recording apparatus which is arranged such that a sheet-like drain-ink absorbing material, such as felt, is disposed on a frame inside the apparatus body immediately below the moving path of the wiping member, to thereby absorb and hold the drain ink. In such an arrangement, the absorbing capacity of the sheet-like drain-ink absorbing material is low, so that the value of application of the invention increases further.

In addition, although in the above-described embodiment the drainage-amount integrating means is arranged to integrate and count the amount of drainage each time the clearing operation has been executed, the drainage-amount integrating means may be arranged to execute integration and counting each time the wiping operation has been executed. In this case, in the same way as in FIG. 8, it is necessary to prepare a map describing discrete values of the amount of drainage for each wiping operation so as to integrate and count a predetermined value each time the wiping operation has been executed, and to store them in advance in a drainage-amount counting table. Further, the drainage-amount integrating means may be arranged to execute integration and counting when operating power supply for the recording apparatus is interrupted.

As is apparent from the foregoing description, according to the ink jet type recording apparatus in accordance with the invention, since the drainage-amount integrating means is provided for integrating and counting the amount of drain ink wiped off the nozzle forming surface by the wiping member, it is possible to prevent excess drain ink from contaminating the interior of the apparatus.

What is claimed is:

1. An ink jet type recording apparatus comprising:

an ink jet type recording head mounted on a reciprocating carriage and adapted to discharge droplets of ink based on print data;

a wiping member for wiping off ink attached to a nozzle forming surface of said recording head in sliding contact with the nozzle forming surface in conjunction with a movement of said carriage;

first drainage-amount integrating means for integrating and counting an amount of drain ink wiped off the nozzle forming surface by said wiping member.

2. An ink jet type recording apparatus according to claim 1, further comprising a draining absorbing material for absorbing and holding the drain ink wiped off the nozzle forming surface by said wiping member.

3. An ink jet type recording apparatus according to claim 2, wherein said wiping member is advanced or retracted with respect to a moving path of said recording head and wipes off the ink attached to the nozzle forming surface by coming into sliding contact with the nozzle forming surface of said recording head when said wiping member advances to the moving path of said recording head, and a drainage receiving member for receiving the drain ink wiped off by said wiping member is disposed below a moving path of said wiping member corresponding to a gravitational direction of said wiping member, and said drainage absorbing material for absorbing and holding the drain ink is disposed in said drainage receiving member.

4. An ink jet type recording apparatus according to claim 1, wherein said first drainage-amount integrating means for integrating and counting the amount of drain ink wiped off the nozzle forming surface by said wiping member is arranged to effect integration and counting each time a wiping operation is executed.

5. An ink jet type recording apparatus according to claim 4, wherein said first drainage-amount integrating means is arranged to integrate and count a predetermined value each time the wiping operation is executed.

6. An ink jet type recording apparatus according to claim 1, wherein said first drainage-amount integrating means for integrating and counting the amount of drain ink wiped off the nozzle forming surface by said wiping member is arranged to effect integration and counting each time an operation of cleaning said recording head is executed.

7. An ink jet type recording apparatus according to claim 6, wherein said first drainage-amount integrating means is arranged to integrate and count a predetermined value each time the operation of cleaning said recording head is executed.

8. An ink jet type recording apparatus according to claim 1, further comprising a second drainage-amount integrating means for integrating and counting the amount of drain ink occurring based on an operation of cleaning said recording head or an operation of flushing said recording head.

9. An ink jet type recording apparatus according to claim 8, further comprising integrated-value determining means for determining whether or not a discrete value of said second drainage-amount integrating means for integrating and counting the amount of drain ink occurring on the basis of the operation of cleaning said recording head or the operation of flushing said recording head, wherein if it is determined by said integrated-value determining means that a predetermined value has been reached, a message is displayed by display means.

10. An ink jet type recording apparatus according to claim 8, further comprising integrated-value determining means for determining whether or not a discrete value of said second drainage-amount integrating means for integrating and counting the amount of drain ink occurring on the basis of the operation of cleaning said recording head or the operation of flushing said recording head, wherein if it is determined by said integrated-value determining means that a predetermined value has been reached, the operation of cleaning said recording head or the wiping operation is prohibited.

11. An ink jet type recording apparatus according to claim 1, wherein said first drainage-amount integrating means for integrating and counting the amount of drain ink wiped off the nozzle forming surface by said wiping member is arranged to effect integration and counting when operating power supply for said recording apparatus is interrupted.

12. An ink jet type recording apparatus according to claim 1, further comprising integrated-value determining means for determining whether of not a discrete value of said first drainage-amount integrating means for integrating and counting the amount of drain ink wiped off the nozzle forming surface by the said wiping member has reached a predetermined value, wherein if it is determined by said integrated-value determining means that the predetermined value has been reached, a message is displayed by display means.

13. An ink jet type recording apparatus according to claim 1, further comprising integrated-value determining means for determining whether or not a discrete value of said first drainage-amount integrating means for integrating and counting the amount of drain ink wiped off the nozzle forming surface by said wiping member has reached a predetermined value, wherein if it is determined by said integrated-value determining means that the predetermined value has been reached, an operation of cleaning said recording head or a wiping operation is prohibited.

* * * * *